US005575692A

United States Patent [19]

Cecil, Jr. et al.

[11] Patent Number: 5,575,692

[45] Date of Patent: Nov. 19, 1996

[54] ELECTRICAL CONNECTOR WITH A REAR END MOUNTED TERMINAL POSITION ASSURANCE DEVICE

[75] Inventors: Paul D. Cecil, Jr., Joliet; Lawrence E. Geib, Bartlett; Anthony J. Pill, Naperville, all of Ill.

[73] Assignee: Molex Incorporated, Lisle, Ill.

[21] Appl. No.: 352,006

[22] Filed: Dec. 8, 1994

[51] Int. Cl.[6] ..... H01R 13/436

[52] U.S. Cl. ..... 439/752

[58] Field of Search ..... 439/752, 595

[56] References Cited

U.S. PATENT DOCUMENTS

| | | | |
|---|---|---|---|
| 4,787,864 | 11/1988 | Hunt, III et al. | 439/595 |
| 4,921,448 | 5/1990 | Endo et al. | 439/595 |
| 5,004,436 | 4/1991 | Aoyama | 439/752 |
| 5,037,336 | 8/1991 | Betsui | 439/752 |
| 5,059,142 | 10/1991 | Ohta et al. | 439/752 |
| 5,061,210 | 10/1991 | Jinno | 439/752 |
| 5,100,345 | 3/1992 | Endo et al. | 439/595 |
| 5,120,269 | 6/1992 | Eno et al. | 439/752 |
| 5,205,763 | 4/1993 | Watanabe et al. | 439/752 |
| 5,224,883 | 7/1993 | Yamamoto | 439/752 |
| 5,322,457 | 6/1994 | Tsuji et al. | 439/595 |
| 5,520,553 | 5/1996 | Cecil, Jr. et al. | 439/595 |

*Primary Examiner*—Gary F. Paumen
*Attorney, Agent, or Firm*—A. A. Tirva

[57] ABSTRACT

An electrical connector includes a housing having a forward mating end and a rearward terminating end and at least one terminal-receiving cavity extending along an axis in a direction between the ends. A terminal is insertable into the cavity from the rearward terminating end of the housing. The terminal has a transversely enlarged portion located at a given axial position when the terminal is fully inserted into the cavity. A TPA device is engageable with the housing at the rearward terminating end thereof. The TPA device includes at least two parts interconnected for relative movement transversely of the axis between open and closed positions. The parts define a passage therebetween for receiving the terminal therethrough when the parts are in their open position. The parts are adapted to abut the enlarged portion of the terminal to prevent movement of the parts to their closed position in the event the terminal is not at least substantially inserted into the cavity and, thereby, indicating a condition of incomplete insertion of the terminal.

17 Claims, 10 Drawing Sheets

(6-10)

ELECTRICAL CONNECTOR WITH A REAR END MOUNTED TERMINAL POSITION ASSURANCE DEVICE

FIELD OF THE INVENTION

This invention generally relates to the art of electrical connectors and, particularly, to an electrical connector which incorporates an improved terminal position assurance device.

BACKGROUND OF THE INVENTION

Generally, an electrical connector includes a dielectric housing mounting at least one electrically conductive terminal therein. The terminal is electrically connected to another circuit component, such as a discrete wire. Connectors often are employed in mateable pairs such that each terminal and the housing of one connector are mateable with a corresponding terminal and the housing of another connector.

The terminals of electrical connectors frequently are very small components, such as components that are stamped and/or formed from thin sheet metal material. A poor quality electrical connection may occur if one or more terminals are not properly seated in its respective housing. The improper seating of a terminal in a housing may occur if the terminal is not fully inserted into the housing during the initial assembly of the connector or if the terminal is vibrated or pulled out of its fully seated condition during use of the connector. Failures of this type are a particular concern in the automotive industry where electrical components are subjected to vibration almost continuously during normal usage and are subjected to direct force during some maintenance. To avoid these problems, the automotive industry often requires connectors to be provided with some form of a terminal position assurance (TPA) system to detect incomplete insertion of the terminals. The automotive industry also generally requires locking means for locking the terminals in the housing, and a TPA system or device also performs this function.

In using a typical TPA device, if the device detects that one or more terminals are not fully seated, a search is required to locate the incompletely inserted terminal(s). This can be a time consuming operation and adds to the cost of the connector assembly operation. The present invention is directed to providing a TPA device which not only detects an incompletely inserted terminal, but the device, itself, can be used to move an incompletely inserted terminal to its fully inserted position.

SUMMARY OF THE INVENTION

An object, therefore, of the invention is to provide a new and improved terminal position assurance ("TPA") device of the character described.

In the exemplary embodiment of the invention, an electrical connector includes a housing having a forward mating end and a rearward terminating end and at least one terminal-receiving cavity extending along an axis in a direction between the ends. A terminal is insertable into the cavity from the rearward terminating end of the housing. The terminal has a transversely enlarged portion located at a given axial position when the terminal is fully inserted into the cavity.

The invention contemplates the provision of a TPA device engageable with the housing at the rearward terminating end thereof. The TPA device includes at least two parts interconnected for relative movement transversely of the axis between open and closed positions and defining a passage therebetween for receiving the terminal therethrough when the parts are in their open position. The parts are adapted to abut the enlarged portion of the terminal to prevent movement of the parts to their closed position in the event the terminal is not at least substantially inserted into the cavity and, thereby, indicating a condition of incomplete insertion of the terminal.

Complementary interengaging latching means are provided between the TPA device and the housing for mounting the device on the housing in a preloaded condition with the two parts of the device in their open position. The latching means include latch components on the housing and on each part of the TPA device.

Complementary interengaging locking means are provided between the TPA device and the housing for locking the two parts of the device in their closed position. The locking means include lock components on the housing and on each part of the TPA device.

In the preferred embodiment of the invention, the two parts of the TPA device are of identical construction. In addition, both male and female connectors are shown herein, and the TPA device on each connector is substantially identical.

Lastly, the two-part TPA device is movable longitudinally of the connector housing when the parts are in their closed position. The device can move an incompletely inserted terminal to its fully inserted position, and the locking means holds the TPA device thereat.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
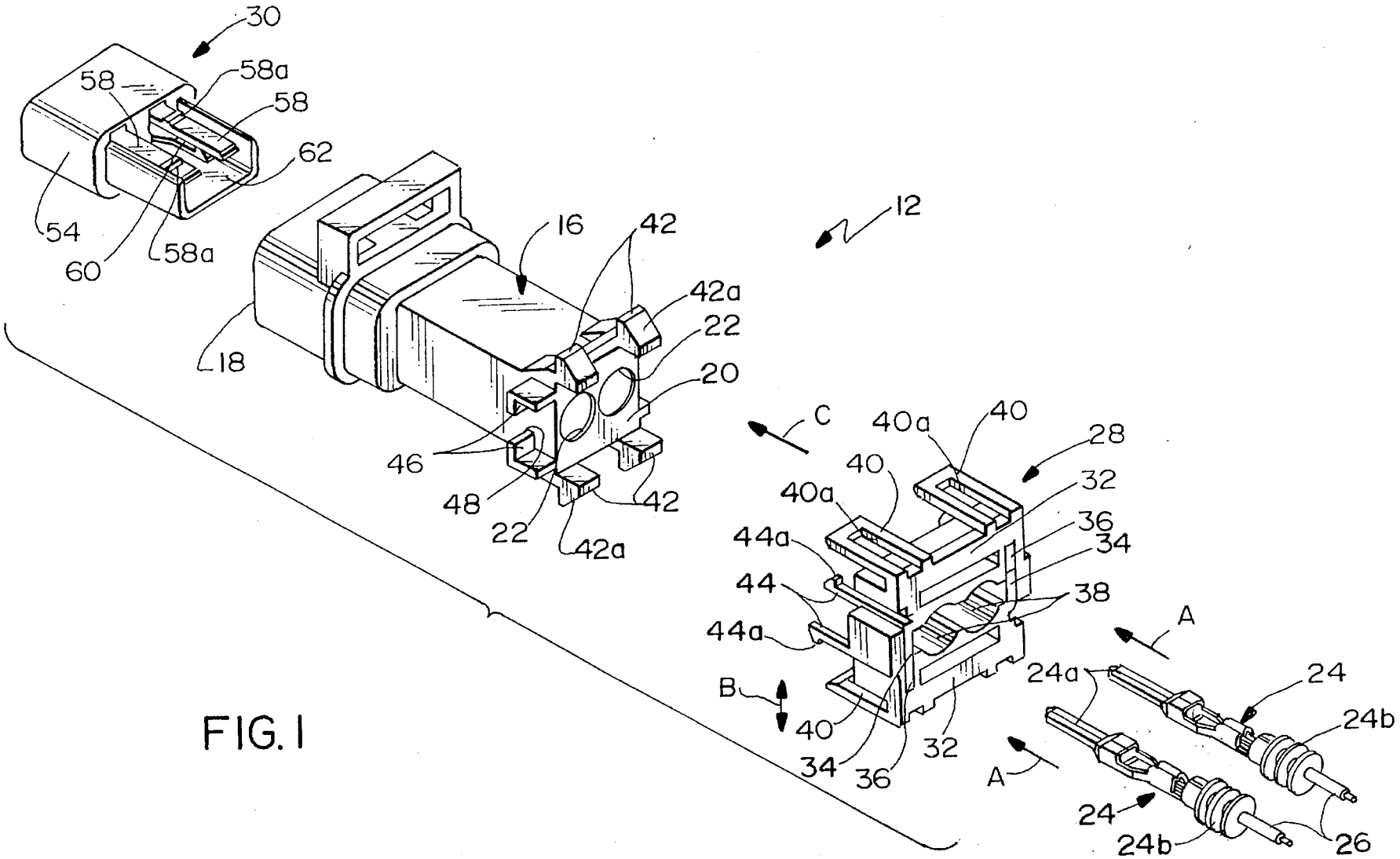
FIG. 1 is an exploded perspective view of a male connector incorporating the TPA device of the invention.

Referring to the drawings in greater detail, FIGS. 1–5 show a male electrical connector, generally designated 12, and FIGS. 6–10 show a mating female electrical connector, generally designated 14. Both connectors incorporate TPA devices embodying the concepts of the invention. Consequently, a detailed description of male connector 12 and its TPA devices first will be presented and, thereafter, a somewhat lesser detailed description of female connector 14 will be presented, because the basic principles of the TPA devices in both connectors are the same.

Turning first to FIG. 1, male connector 12 includes a housing, generally designated 16, which has a forward mating end 18 and a rearward terminating end 20. The housing is unitarily molded of dielectric material such as plastic or the like. A pair of terminal-receiving cavities 22 extend along axes in a direction between the mating and terminating ends of the housing. A pair of terminals, generally designated 24, are insertable into cavities 22 in the direction of arrows "A" from rearward terminating end 20 of housing 16. The terminals have front blade portions 24*a* and rear enlarged portions 24*b*. The terminals are terminated to electrical cables or wires 26.

A first terminal position assurance ("TPA") device, generally designated 28, is engageable with housing 16 of male connector 12 at rearward terminating end 20 thereof. A second TPA device, generally designated 30, is engageable with housing 16 within forward mating end 18 thereof.

More particularly, rear TPA device 28 is a two-part structure including identical first and second parts 32 having tongue-like flanges 34 press fit within grooves 36 of the opposite part. Therefore, the two parts 32 of TPA device 28 are interconnected for movement relative to each other in the direction of double-headed arrow "B" transversely of the longitudinal axis of the connector. Each part is unitarily molded of dielectric material such as plastic or the like. The two parts of TPA device 28 define a pair of passages 38 therebetween for receiving terminals 24 therethrough when the parts are in their relative open positions described hereinafter. In essence, the two parts of TPA device 28 are movable between open and closed positions in the direction of double-headed arrow "B".

Generally, complementary interengaging latching means are provided between TPA device 28 and housing 16 for mounting the device on the housing in a preloaded condition with parts 32 of the device in their open position. More particularly, referring to FIG. 2 in conjunction with FIG. 1, each part 32 of TPA device 28 includes a pair of flexible cantilevered latch arms 40 having slots 40*a* for snappingly engaging over a pair of latch bosses 42 projecting rearwardly of housing 16 at rearward terminating end 20 thereof. TPA device 28 is mounted to housing 16 in the direction of arrow "C" whereupon the distal ends of latch arms 40 engage camming surfaces 42*a* of latch bosses 42, and the latch arms will embrace the latch bosses with the latch bosses disposed within slots 40*a* of the arms. This preloaded condition of the two-part TPA device is shown in FIG. 2.

Generally, complementary interengaging locking means are provided between TPA device 28 and housing 16 for locking the two parts of the device in a closed position (described hereinafter) and for locking the device in its final assembled position. More particularly, each part 32 of the two-part TPA device has a pair of flexible cantilevered locking arms 44 having hooked distal ends 44*a*. Housing 16 includes a pair of transversely oriented flanges 46 on each side of the housing, with an opening 48 between the flanges.

Figure 2:
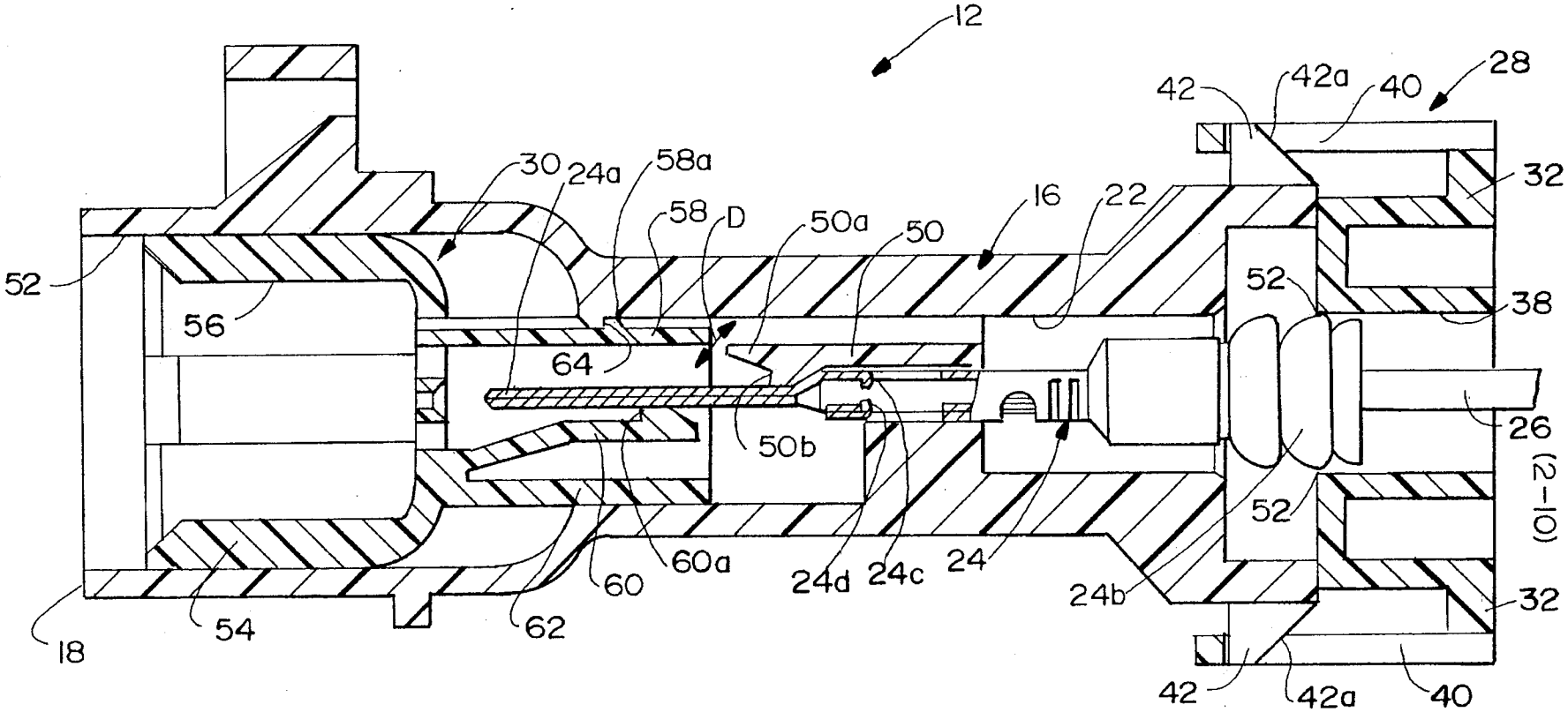
FIG. 2 is an axial section through the male connector, with the two-part TPA device at the rear of the connector in its open position, with the TPA device at the front of the connector in its preloaded position and with the terminal only partially inserted into the connector.

Before proceeding with a description of the operation of two-part TPA device 28, reference is made to FIG. 2 wherein it can be seen that a primary locking arm 50 is formed on housing 16 and is located within each terminal-receiving cavity 22. The locking arm is molded integrally with the housing and includes a distal end 50*a* which is pivotal in an arcuate path as indicated by double-headed arrow "D" transversely of the insertion direction of terminals 24. A locking shoulder 50*b* is provided on the inside of primary locking arm 50 near distal end 50*a* thereof. The locking shoulder is adapted to abut against a top locking shoulder 24*c* as described hereinafter. The terminal also includes a bottom locking shoulder 24*d* for purposes described hereinafter.

In operation, two-part TPA device 28 first is preliminarily mounted on housing 16 in a preloaded condition as shown in FIG. 2. Latch arms 40 of the TPA device embrace latch arms 42 of connector housing 16 in the preloaded condition of the TPA device. It also should be understood that the two parts 32 of the TPA device are in their transversely open position. In this position, terminals 24 can be inserted through passages 38 between the two parts of the TPA device and into the terminal-receiving cavities 22 of connector housing 16. FIG. 2 shows a condition wherein the terminal 24 illustrated therein is only partially inserted into its cavity. In this position, it can be seen that the two parts 32 of TPA device 28 are in transverse abutting alignment with enlarged portion 24*b* of the terminal, as at 52. Therefore, the two parts of the TPA device cannot be moved toward each other in the transverse direction which, thereby, indicates a condition of incomplete insertion of the terminal.

Figure 3:
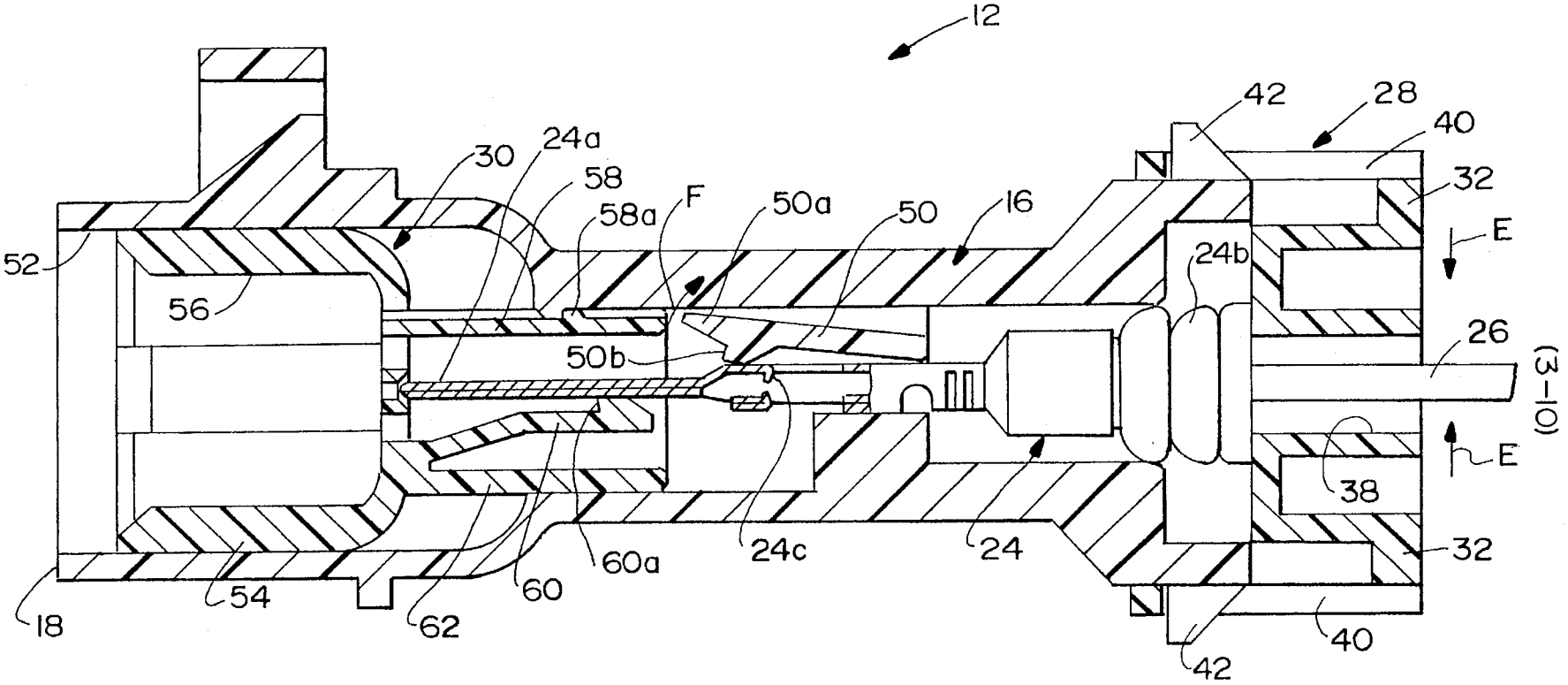
FIG. 3 is a view similar to that of FIG. 2, but with the terminal further inserted into the connector and with the two-part TPA device at the rear of the connector in its closed position.

FIG. 3 shows a condition of terminal 24 and TPA device 28 wherein the terminal still is not fully inserted, but the terminal has been moved sufficiently for the two parts 32 of TPA device 28 to move together or toward each other in the direction of arrows "E" to their closed position. The TPA device, itself, still is in its preloaded condition with latch arms 40 still embracing latch bosses 42 on the connector housing. It also can be seen in FIG. 3 that terminal 24 has cammed the distal end 50*a* of primary locking arm 50 transversely in the direction of arrow "F". However, it should be noted that locking shoulder 50*b* of the primary locking arm still has not engaged top locking shoulder 24*c* of the terminal.

Figure 4:
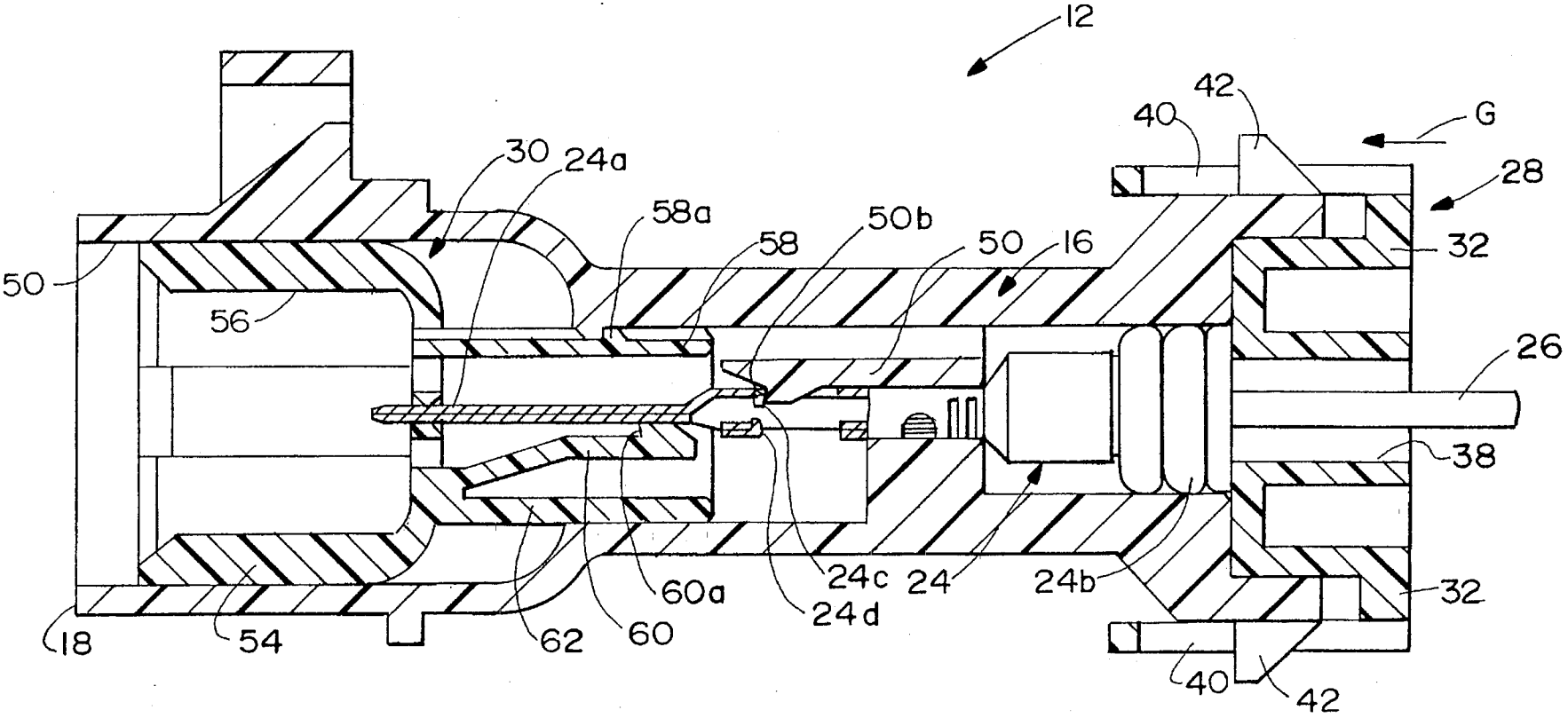
FIG. 4 is a view similar to that of FIG. 3, but with the terminal fully inserted and the two-part TPA device at the rear of the connector moved into its locked position.

FIG. 4 shows a condition wherein TPA device 28 has been moved forwardly in the direction of arrow "G" and terminal 24 is in its fully inserted position, with locking shoulder 50*b* of primary locking arm 50 in locking engagement with top locking shoulder 24*c* of the terminal. It should be understood that terminal 24 in FIGS. 2–4 could have been moved to its fully inserted position as shown in FIG. 4 in the very first instance, as is normally expected. In such instances, the two parts 32 of TPA device then simply would be moved toward each other to their closed position, and the TPA device would be moved forwardly in the direction of arrow "G" (FIG. 4) to its final position without incurring any interference whatsoever with or by the terminal. However, if the terminal is substantially inserted as shown in FIG. 3 but not fully inserted as shown in FIG. 4, the TPA device, itself, can be used to push on the terminal and move the terminal to its fully inserted position. Lastly, when the TPA device is in its final position shown in FIG. 4, hooked distal ends 44*a* (FIG. 1) of locking arms 44 snappingly lock behind flanges 46 on housing 16. This locked condition locks the two parts of the TPA device in their closed position, locks the TPA device in its forward final position and, thereby, also locks the terminal in its fully inserted position due to abutment of the TPA device with the rear of enlarged portion 24*b* of the terminal as seen in FIG. 4. Of course, this is in addition to the primary locking of the terminal afforded by primary locking arm 50.

Referring back to FIG. 1 in conjunction with FIG. 2, front TPA device 30 of male connector 12 is entirely positionable within an opening 52 at forward mating end 18 of connector housing 16. The TPA device includes a hollow front end 54 defining an interior passage 56. In other words, front end 54 is hollow for receiving a mateable connecting device, as described hereinafter.

TPA device 30 includes a pair of top latch arms 58 and a pair of bottom lock arms 60 all protected by an outer shroud 62. Latch arms 58 have latch hooks 58*a* and lock arms 60 have lock hooks 60*a*. The latch hooks are adapted for latching behind latch shoulders 64 of housing 16 within cavity 22, and lock hooks 60*a* are adapted for locking engagement with bottom locking shoulders 24*d* of terminals 24 as described hereinafter.

In operation of front TPA device 30 of male connector 12, the TPA device is assembled within opening 52 at forward mating end 18 of housing 16 in a first or preloaded position shown in FIG. 2, with latch hooks 58*a* of latch arms 58 interengaged with latch shoulders 64 of the connector housing. In this first or preloaded position of the TPA device, primary locking arm 50 is free to move in the direction of double-headed arrow "D" (FIG. 2) in response to insertion of the terminal.

As seen in FIGS. 3 and 4, front TPA device 34 remains in its first or preloaded position during full insertion of terminal 24 and during the various movements or phases of operation of the two-part rear TPA device 28.

Figure 5:
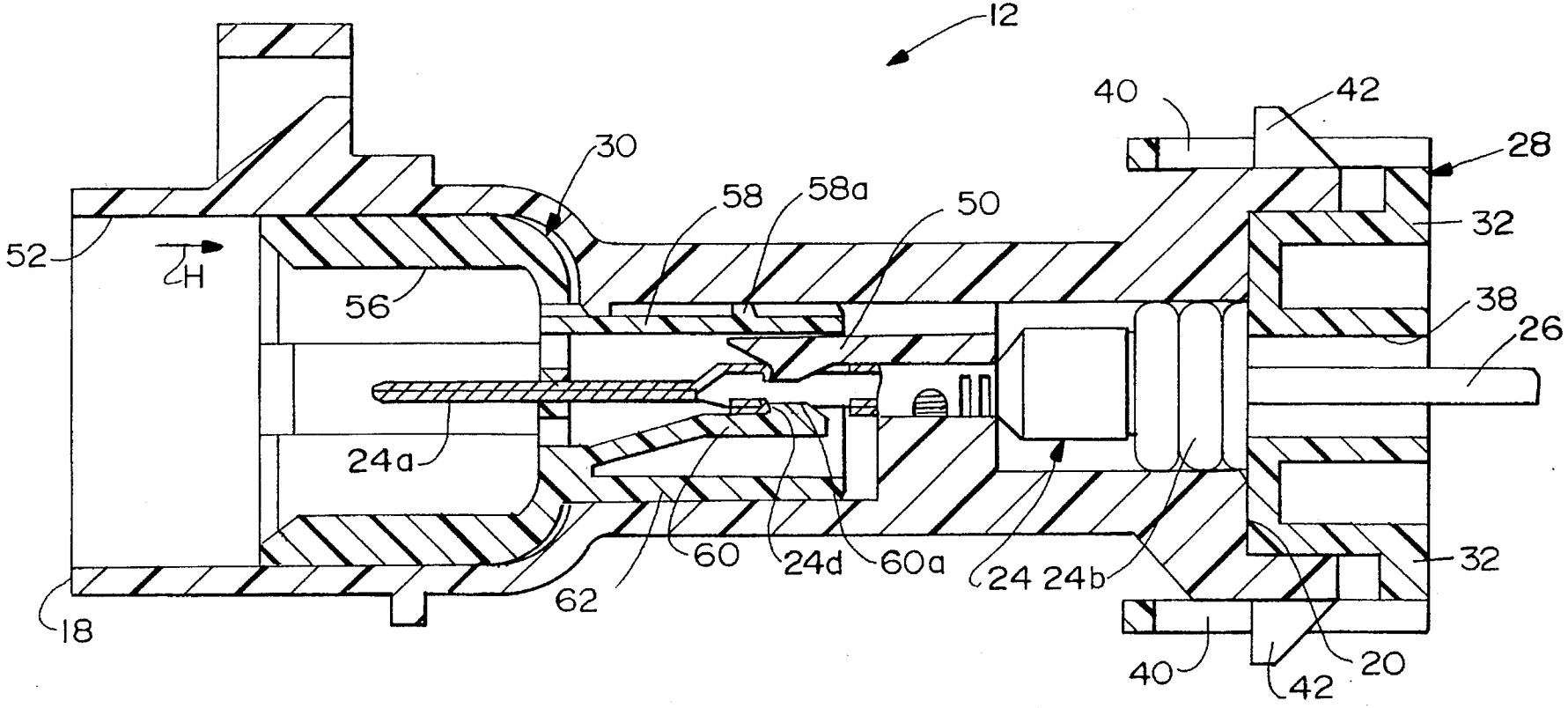
FIG. 5 is a view similar to that of FIG. 4, but with the TPA device at the front of the connector moved to its final position.

Once terminal 24 is fully inserted and rear TPA device 28 is in its final locked position, front TPA device 30 is moved in the direction of arrow "H" in FIG. 5 to a second locking position. In this position, two structural conditions result. First, it can be seen in FIG. 5 that latch arm 58 now blocks movement of primary locking arm 50 out of locking interengagement with terminal 24. Second, hook 60*a* of lock arm 60 is in locking interengagement with bottom locking shoulder 24*d* of the terminal. Therefore, lock arms 60 provide secondary locking means between front TPA device 30 and the terminals when the terminals are in their fully inserted position and the TPA device is in its second or locking position. Of course, reference is made back to FIG. 3 wherein it can be understood that primary locking arm 50 blocks movement of TPA device 30 if terminal 24 is only partially inserted and, thereby, indicates the incomplete insertion condition of the terminal.

Figure 6:
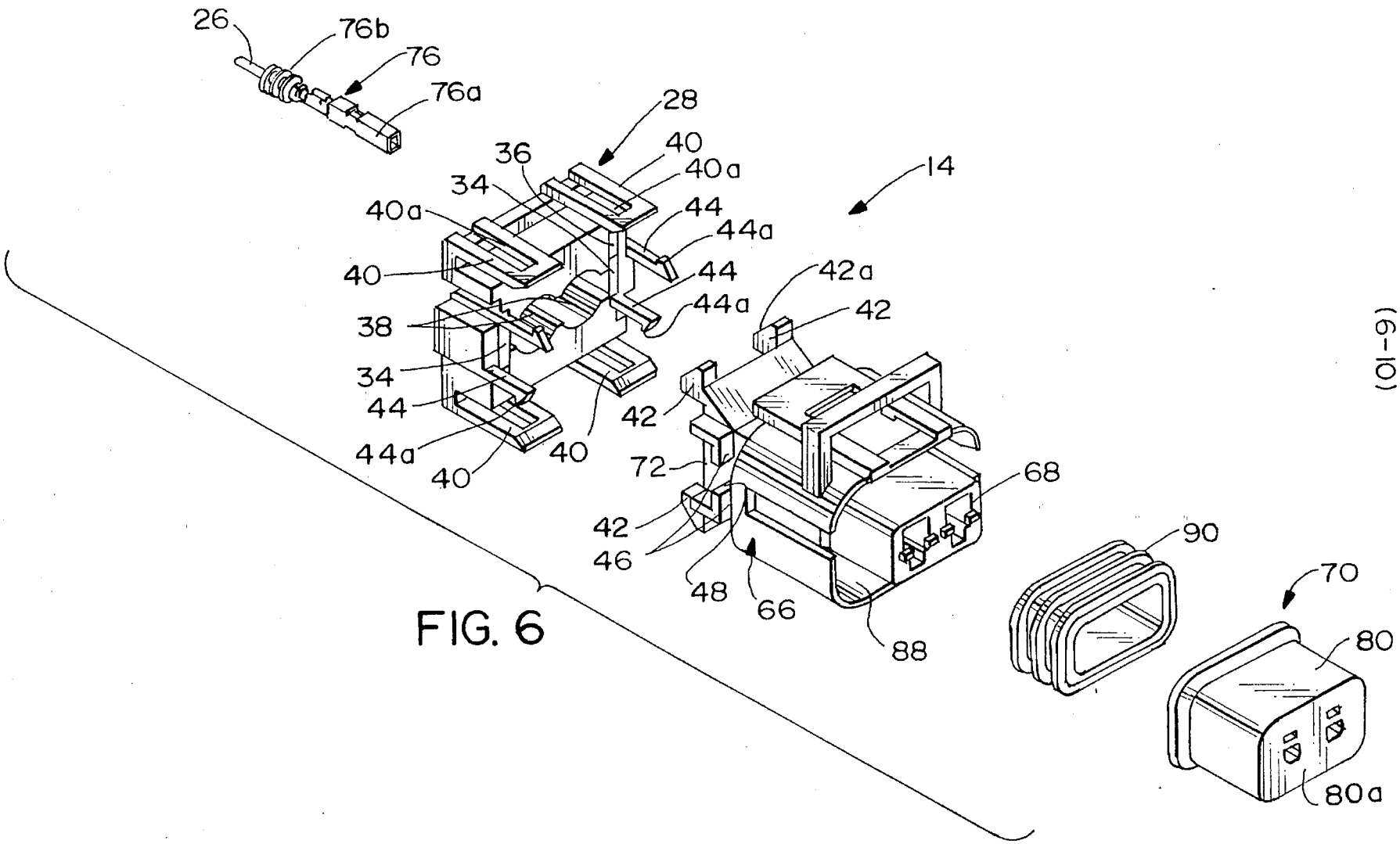
FIG. 6 is an exploded perspective view of a female connector incorporating the TPA device of the invention.

As stated above, FIGS. 6–10 show female connector 14 which incorporates front and rear TPA devices similar or identical to the TPA devices described above as incorporated in male terminal 12 in FIGS. 1–5. In particular, female connector 14 is shown in FIG. 6 to include a housing, generally designated 66, which is unitarily molded of dielectric material such as plastic or the like. The housing has a forward mating end 68 at which a front TPA device, generally designated 70, is interengaged, and a rearward terminating end 72 at which a rear TPA device, generally designated 28, is interengaged. The housing has a pair of terminal-receiving cavities 72 (FIG. 7) for receiving a pair of terminals, generally designated 76. The terminals are similar to terminals 24 in FIGS. 1–5, in that each terminal has a front mating portion 76*a* and a rear enlarged portion 76*b*, with the terminal being terminated to appropriate electrical cables or wires 26. The difference between terminals 76 and terminals 24 is that the front mating portions 76*a* of terminals 76 are of socket configurations for receiving therein appropriate pin terminals, such as the blade portions 24*a* of terminals 24.

Rear TPA device 28 of female connector 14 is identical to rear TPA device 28 of male connector 12 and will not be described in as great a detail at this point. Suffice it to say, TPA device 28 in FIGS. 6–10 include two parts 32 having tongue-like flanges 34 press-fit within grooves 36, and the two parts define passages 38 therebetween. The parts include flexible cantilevered latch arms 40 having slots 40*a* therewithin for engaging latch bosses 42 on female connector housing 66. The parts have flexible cantilevered locking arms 44 with hooked distal ends 44*a* for interengagement with flanges 46 on the female connector housing. TPA device 28 operates and functions on female connector 14 identical to the above description of TPA device 28 on male connector 12. In fact, FIGS. 7–10 can be compared to FIGS. 2–5 and the above descriptions in regard thereto in order to completely understand the operation of TPA device 28 in female connector 14.

Figure 7:
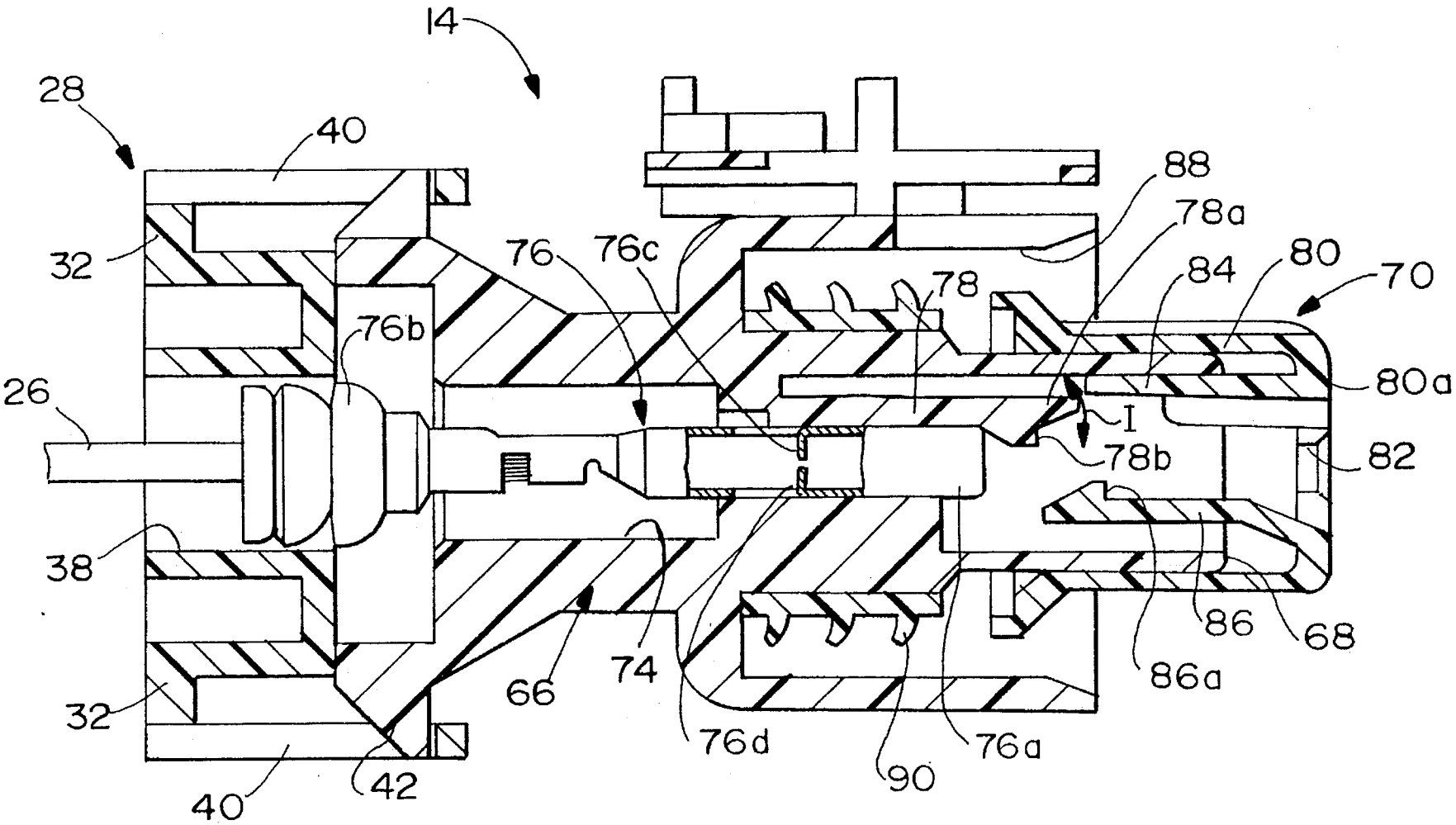
FIGS. 7–10 are views similar to FIGS. 2–5, respectively, showing the same sequential positions of the terminal and the TPA devices for the female connector of FIG. 6.

Before proceeding with a detailed description of front TPA device 70 of female connector 14, reference is made to FIG. 7 wherein it can be seen that housing 66 of the female connector includes a primary locking arm 78 similar in structure and function to primary locking arm 50 of male connector 12. Primary locking arm 78 includes a distal end 78*a* that is pivotal in an arc as indicated by double-headed arrow "I". The locking arm includes a locking shoulder 78*b* for locking interengagement with a top locking shoulder 76*c* of terminal 76. Like terminal 24, terminal 76 includes a bottom locking shoulder 76*d*.

Referring to FIG. 7 in conjunction with FIG. 6, front TPA device 70 of female connector 14 includes a generally hollow front portion 80 having a front face 80*a* defining passages 82 therethrough and through the TPA device at forward mating end 68 of connector housing 66. The passages are adapted for receiving mateable connecting devices, such as blade portions 24*a* of terminals 24 of male connector 12. Upper latch arms 84 and lower lock arms 86 are cantilevered rearwardly within TPA device 70 on opposite sides of passages 82. Lock arms 86 have locking shoulders 86*a* for locking engagement with bottom locking shoulders 76*d* of terminals 76. TPA device 70 is at least partially positionable in an opening 88 at the forward mating end of housing 66. A ribbed seal 90 is located within opening 88.

Figure 8:
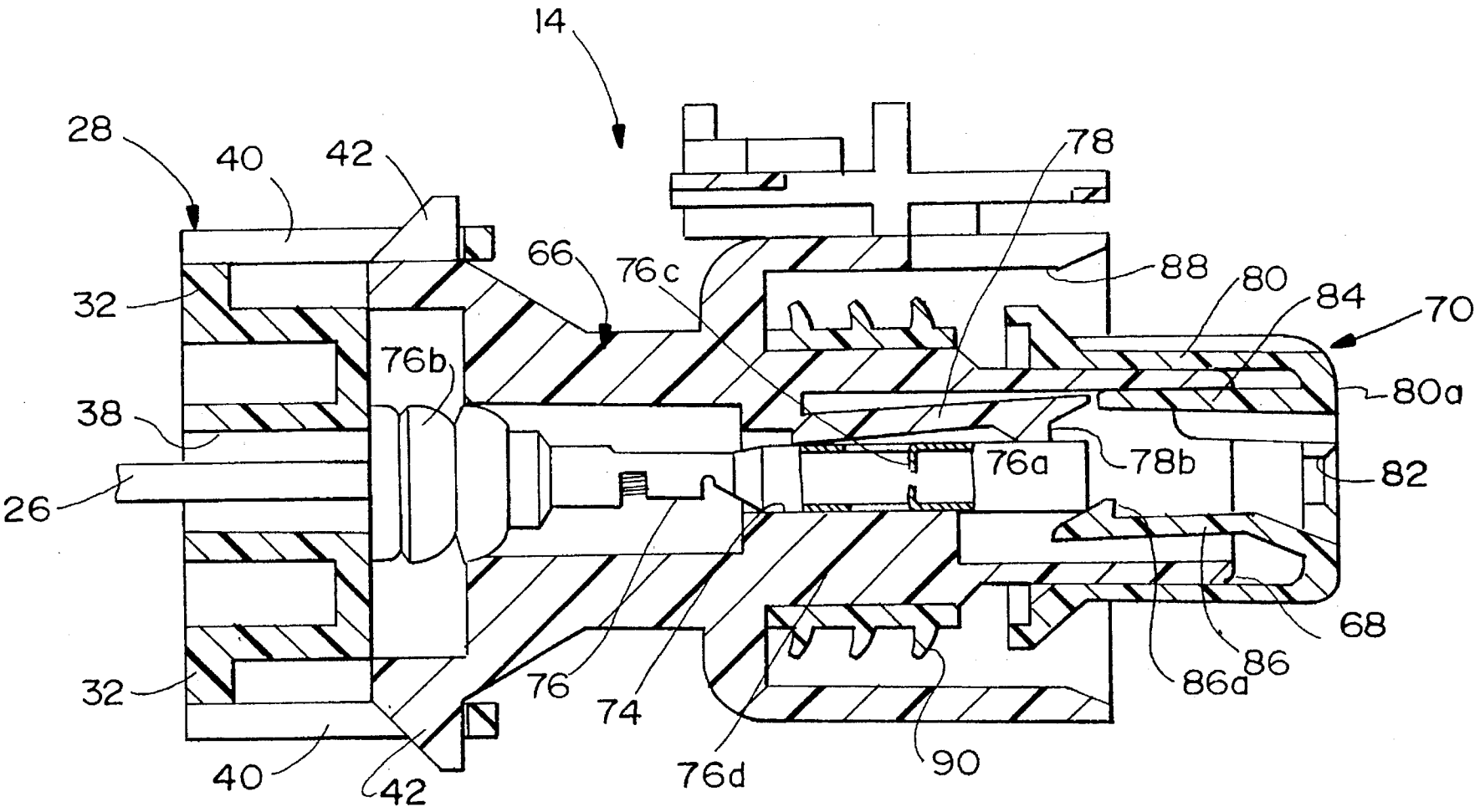
Figure 9:
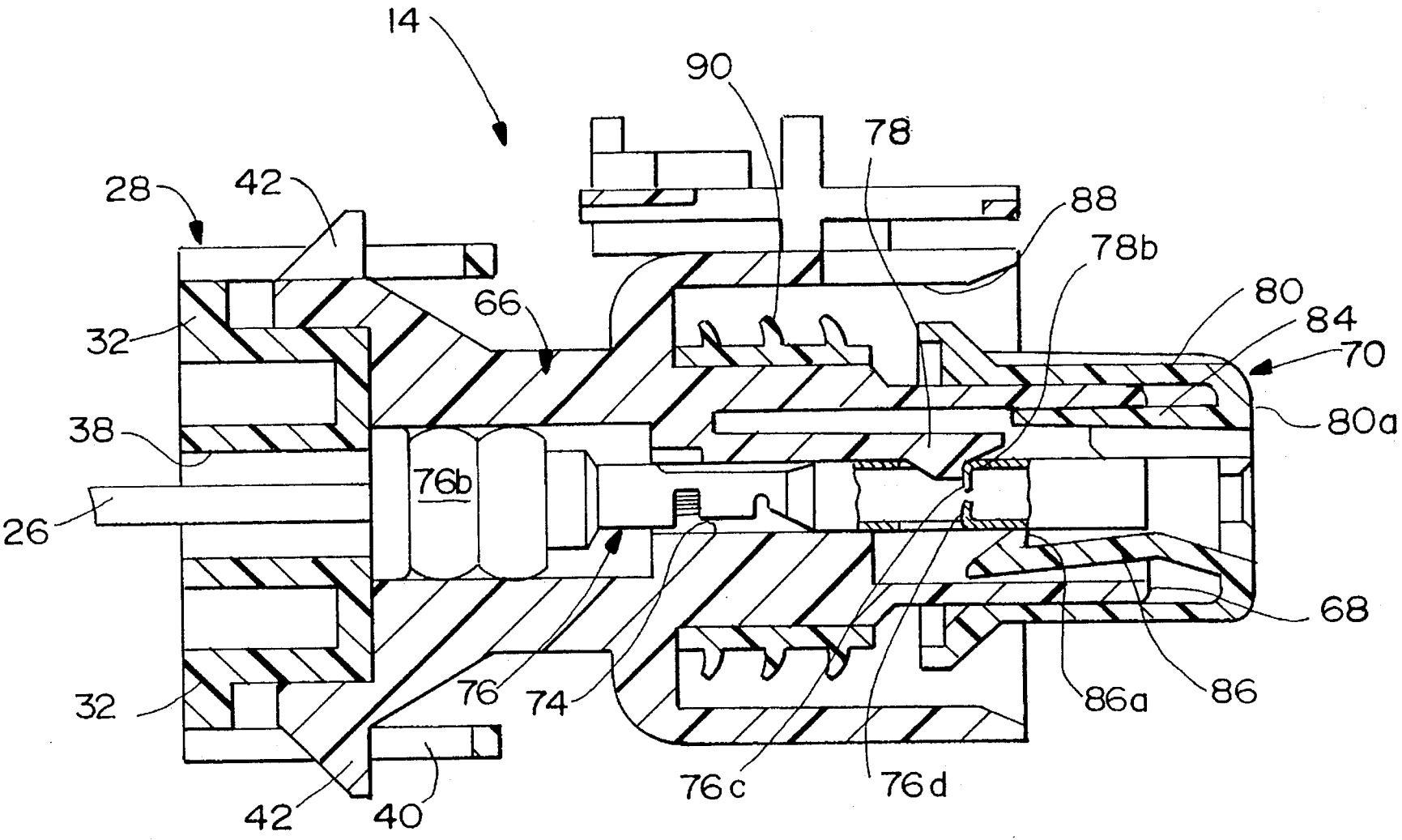
Figure 10:
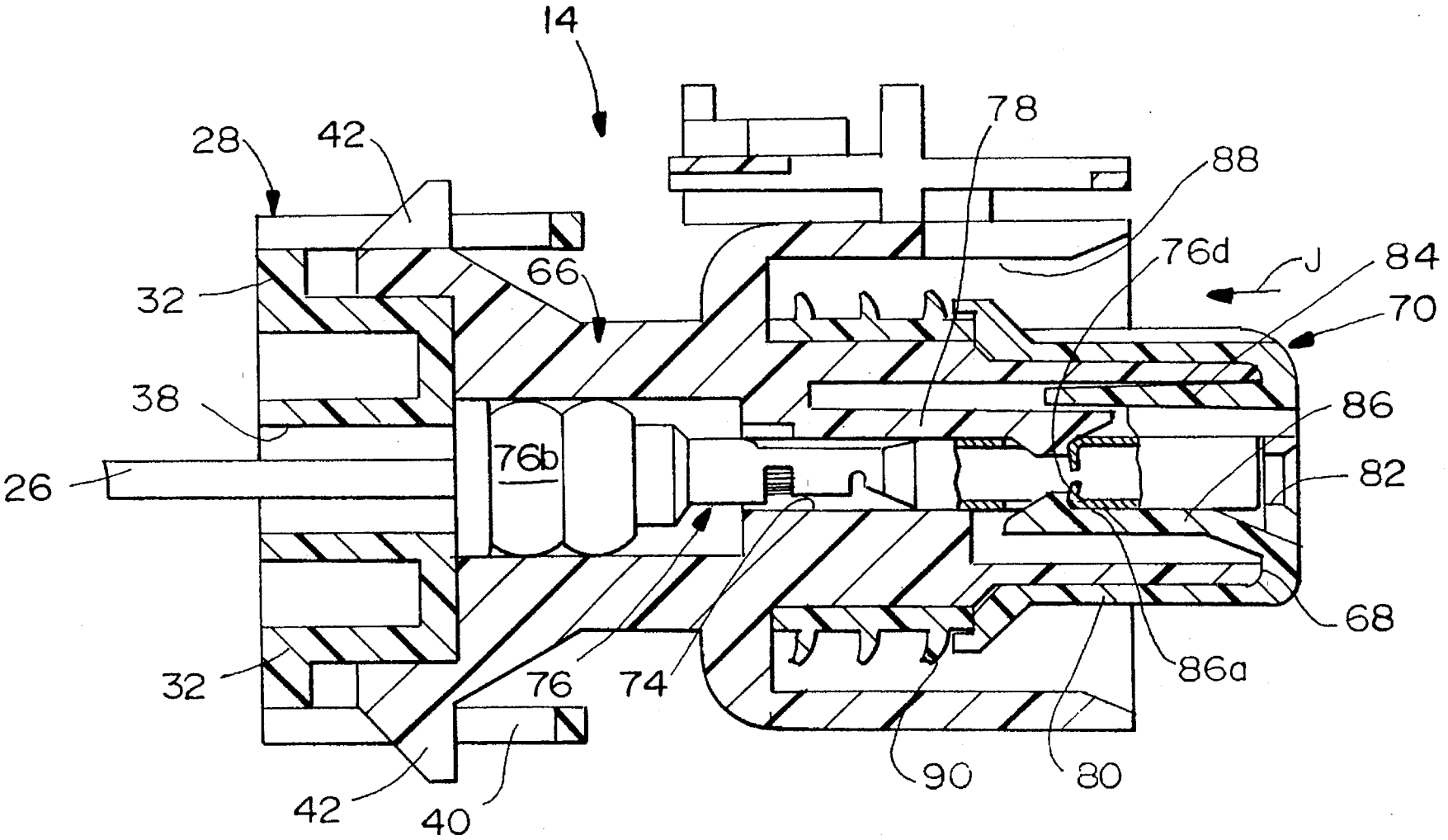

Front TPA device 70 of female connector 14 is movable between a first position shown in FIGS. 7–9 and a second position shown in FIG. 10. In the first position of FIGS. 7–9, it can be seen that latch arms 84 within the TPA device allow free movement of primary locking arm 78 and full insertion of terminal 76. Once the terminal is fully inserted, the TPA device is pushed inwardly in the direction of arrow "J" (FIG. 10) to its second position shown in FIG. 10. In this position, like TPA device 30 of male connector 12, TPA device 70 performs two functions. First, latch arm 84 blocks movement of primary locking arm 78 out of its locking interengagement with terminal 76, as shown. Second, hook 86*a* of lock arm 86 now is in locking interengagement against bottom locking shoulder 76*d* of terminal 76.

In summation, it can be understood that the terminal locking and TPA systems of male connector 12 and female connector 14 provide various redundancies to absolutely assure full insertion of the terminals into their respective connectors. This is very important in such applications as the automotive industry wherein secure electrical connections are critical to vehicular operation and personal safety. Of course, primary locking arm 50 of male connector 12 and primary locking arm 78 of female connector 14 are the primary locking mechanisms of the connectors. However, the front TPA devices 30 and 70 both block movement of the primary locking arms away from their locking interengagements with the terminals, and the front TPA devices also provide secondary locking means in the form of their separate lock arms 60 and 86. If one of the terminals is not fully inserted, the front TPA devices cannot be moved to their operative positions because the primary locking arms will block such movement and, thereby, indicate an incomplete terminal insertion condition. Rear TPA devices 28 add still redundant protection for the entire system. The rear TPA devices not only afford an indication of incomplete terminal conditions, but the TPA devices can be used to assist in fully inserting the terminals and providing yet a third locking mechanism for the terminals as described in detail above.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising:

a housing having a forward mating end and a rearward terminating end and at least one terminal-receiving cavity extending along an axis in a direction between the ends;

a terminal insertable into the cavity from the rearward terminating end of the housing, the terminal having a transversely enlarged portion located at a given axial position when the terminal is fully inserted into the cavity; and a TPA device engageable with the housing at said rearward terminating end thereof, the TPA device including at least two parts interconnected for relative movement transversely of said axis between open and closed positions and defining a passage therebetween for receiving the terminal therethrough when the parts are in their open position, the parts being adapted to abut the enlarged portion of the terminal to prevent movement of the parts to their closed position in the event the terminal is not at least substantially inserted into the cavity and, thereby, indicating a condition of incomplete insertion of the terminal.

2. The electrical connector of claim 1, including complementary interengaging latching means between the TPA device and the housing for mounting the device on the housing in a preloaded condition with the two parts of the device in their open position.

3. The electrical connector of claim 2 wherein said latching means include latch components on the housing and on each part of the TPA device.

4. The electrical connector of claim 1, including complementary interengaging locking means between the TPA device and the housing for locking the two parts of the device in their closed position.

5. The electrical connector of claim 4 wherein said locking means include lock components on the housing and on each part of the TPA device.

6. The electrical connector of claim 4, including complementary interengaging latching means between the TPA device and the housing for mounting the device on the housing in a preloaded condition with the two parts of the device in their open position.

7. The electrical connector of claim 6 wherein said latching means include latch components on the housing and on each part of the TPA device.

8. The electrical connector of claim 1 wherein said two parts of the TPA device are of identical construction.

9. The electrical connector of claim 1, including shoulder means on the TPA device for engaging the enlarged portion of the terminal to assist in fully inserting the terminal in response to movement of the TPA device axially of the housing.

10. In an electrical connector which includes a housing having a forward mating end and a rearward terminating end and at least one terminal-receiving cavity extending along an axis in a direction between the ends;

a terminal insertable into the cavity to a fully inserted position; and a TPA device engageable with the housing to facilitate assuring that the terminal is in a fully inserted position in the cavity;

wherein the improvement comprises:

said TPA device including at least two parts interconnected for relative movement transversely of said axis between open and closed positions, the parts being adapted to abut a portion of the terminal to prevent movement of the parts to their closed position in the event the terminal is not at least substantially inserted into the cavity thereby indicating a condition of incomplete insertion of the terminal.

11. The electrical connector of claim 10, including complementary interengaging latching means between the TPA device and the housing for mounting the device on the housing in a preloaded condition with the two parts of the device in their open position.

12. The electrical connector of claim 11, including complementary interengaging locking means between the TPA device and the housing for locking the two parts of the device in their closed position.

13. The electrical connector of claim 12, including complementary interengaging latching means between the TPA device and the housing for mounting the device on the housing in a preloaded condition with the two parts of the device in their open position.

14. The electrical connector of claim 10 wherein said two parts of the TPA device are of identical construction.

15. The electrical connector of claim 10, including shoulder means on the TPA device for engaging a portion of the terminal to assist in fully inserting the terminal in response to axial movement of the TPA device relative to the housing.

16. An electrical connector, comprising:

a housing having a terminal-receiving cavity;

a terminal insertable along an axis into the cavity to a fully inserted position; and a TPA device engageable with the housing and including at least two parts interconnected for relative movement transversely of said axis between first and second positions, the parts being adapted to abut a portion of the terminal to prevent movement of the parts to their second position in the event the terminal is not at least substantially inserted into the cavity thereby indicating a condition of incomplete insertion of the terminal, the TPA device being adapted for axial movement relative to the housing to a locked position when the parts are in their second position.

17. The electrical connector of claim 16, including shoulder means on the TPA device for engaging a portion of the terminal to assist in fully inserting the terminal in response to axial movement of the TPA device relative to the housing.

* * * * *